United States Patent [19]

Stevens

[11] 4,393,941

[45] Jul. 19, 1983

[54] CHIMNEY FIRE SNUFFER

[76] Inventor: Barry A. Stevens, Box 122, Leland Ave., North Springfield, Vt. 05150

[21] Appl. No.: 240,437

[22] Filed: Mar. 4, 1981

[51] Int. Cl.[3] ..... A62C 13/24

[52] U.S. Cl. ..... 169/70; 239/550

[58] Field of Search ..... 169/54, 70, 66, 68, 169/46, 47, 52; 239/550, 443; 134/166 R, 166 C, 167 C; 118/305, 306

[56] References Cited

U.S. PATENT DOCUMENTS

| | | | |
|---|---|---|---|
| 978,597 | 12/1910 | Kennedy | 239/550 |
| 1,485,754 | 3/1924 | Albini | 169/54 |
| 1,898,117 | 2/1933 | Boosey | 169/70 |
| 2,813,753 | 11/1957 | Roberts | 169/70 |
| 3,190,563 | 6/1965 | De Groot | 239/550 |
| 3,690,560 | 9/1972 | Boyd | 169/70 |

*Primary Examiner*—H. Grant Skaggs
*Assistant Examiner*—Kenneth Noland
*Attorney, Agent, or Firm*—Sughrue, Mion, Zinn, Macpeak and Seas

[57] ABSTRACT

A hollow cylindrical heavy metal body terminates at one end in a tapered impact section, while its opposite end bears a threaded hose coupling for coupling of the hollow body to the end of a water hose. A plurality of spray nozzles mounted to the cylindrical body open to the hollow interior and bear fine diameter holes for spraying water under pressure in mist form circumfertially of the body. The body may be lowered by the garden hose or the like with the impact section penetrating accumulating creosote. The water spray rapidly puts out chimney fires without extensive water damage.

3 Claims, 3 Drawing Figures

CHIMNEY FIRE SNUFFER

FIELD OF THE INVENTION

This invention relates to fire apparatus, and more particularly, to an attachment for attaching to a standard garden hose to permit vertical dropping of the attachment through a chimney interior to put out chimney fires and more particularly to one which is capable of penetrating accumulated creosote within the chimney causing the fires.

BACKGROUND OF THE INVENTION

With the advent of wood burning stoves as a means for reducing home heating costs, there has been a considerable increase in chimney fires, principally due to the accumulation of unburned creosote within the chimney itself, above the stove or fireplace within which wood is burned. While such creosote can be removed periodically by proper maintenance, such maintenance is often not accomplished, and sparks and burning particles rising upwardly through the chimney act to ignite the accumulated unburned creosote resulting in a chimney fire. Since the fire itself is within a confined space, not easily reachable, it is difficult to put out. Further, since the chimney opens at its lower end diectly into the building interior, either by way of an open fireplace or by way of a stove pipe attachment to the stove, any attempts to put the chimney fire out by water from a conventional fire hose, which emits a large volume stream under certain circumstances does not rapidly extinguish the blaze, and under all circumstances, floods the interior of the home residence or other building.

Attempts have been made to extinguish such fireplace chimney fires in by spraying water on the flame by a device put into the fireplace, i.e., the bottom of the chimney, and spraying the liquid upwardly. This is ineffective, particularly where the point of the fire is well above the access to the chimney from the fireplace, that is, at its lower end.

Further, where attempts have been made to reach the point of the fire from the top of the chimney, such attempts have been frustrated by the accumulation of the creosote which is the source of the fire. Further spraying from the top of the chimney results in an ineffective water treatment to the surface area of the chimney interior which bears the creosote under combustion.

It is, therefore, a primary object of the present invention to provide an improved chimney fire snuffer which may be readily attached to a conventional garden watering hose, can be lowered through the chimney from the top, which readily penetrates the accumulated creosote and which quickly extinguishes the blaze with minimum application of water, virtually eliminating water damage to the chimney or the building interior.

SUMMARY OF THE INVENTION

The present invention is directed to a chimney fire snuffer comprising a hollow heavy metal body bearing a plurality of spray nozzles which are mounted to the periphery of the hollow body forming a circumferentially spaced array. The nozzles bear fine diameter spray holes opening to the hollow body interior and creating a fine water mist spray over the full circumference of the body when the body is coupled, at one end, to a water hose bearing water under pressure. The body being formed of heavy metal allows the end remote from the coupling to the water hose functions to break through accumulated creosote tending to block the chimney passage. Preferably, the hollow body is cylindrical in form and terminates at its end opposite the end coupled to the water hose in a tapered nose which functions as an impact section for penetrating the accumulated creosote. The impact section may constitute a separate conical end piece threaded to the hollow cylindrical body proper. The body may comprise tapped and threaded bores about its periphery at longitudinally and circumferentially spaced positions, with the body counterbored from the outer periphery of the hollow cylindrical such that the radially outboard ends of the spray nozzle are recessed to eliminate interference during downward penetration of the chimney fire snuffer through the accumulated creosote of the chimney when being lowered and further prevention of interference to the creation of the fine mist water sprays emanating from the nozzle spray holes.

DESCRIPTION OF THE PREFERRED EMBODIMENT

Figure 1:
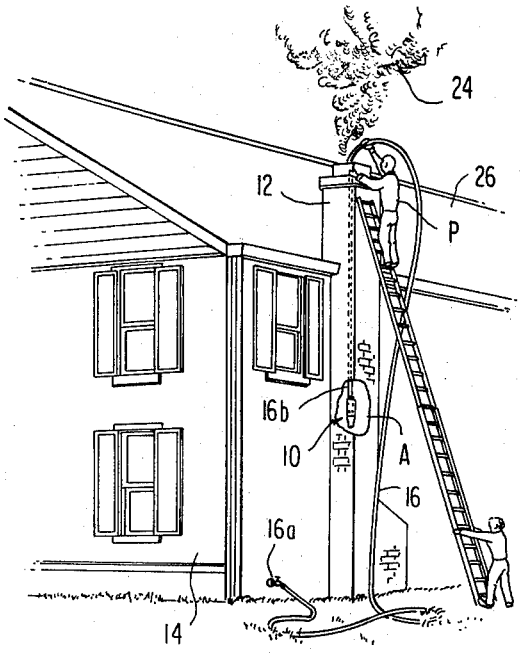
FIG. 1 is a perspective view of the improved chimney fire snuffer as a preferred embodiment as attached to the end of a water hose and lowered within a chimney for snuffing a chimney fire.

Referring to the drawings, the present invention is directed to a chimney fire snuffer indicated generally at 10 which functions to put out a fire within a vertical chimney 12 of a home residence or like building structure 14. While not necessarily limited to attachment of the snuffer 10 to one end of a conventional garden hose 16, such is most appropriate particularly where it can be readily set up to put out the fire by threaded attachment of one end of the hose as at **16*a* to a spigot 18 exterior of the residence 14, and its opposite end 16*b* to the snuffer body indicated generally at 20**.

The fire within the chimney 12 is put out by gravity drop of the heavy metal snuffer body 20 downwardly, through the chimney 12 from its upper end **12*a* by a person P who in the illustration of FIG. 1 is shown as standing on a ladder 22 which is propped up against the side of the chimney 12. The person P grasps the garden hose 16 and simply lowers the snuffer through the interior of the chimney 12 to place the body 20 in the area A of the flames. Normally, the chimney 12 becomes coated with a heavy layer of creosote capable of substantially blocking the flue of the chimney and which creosote, being combustible, supports combustion which is normally caused by flaming ash and the like rising with the hot air and smoke as at 24 which discharges from the top of the chimney 12**.

Alternatively, the person P may approach the top of the chimney by walking on the roof 26 of the building 14 to the point where the end of the hose 16 bearing the snuffer 10 can be lowered within the open top of the chimney.

Figure 2:
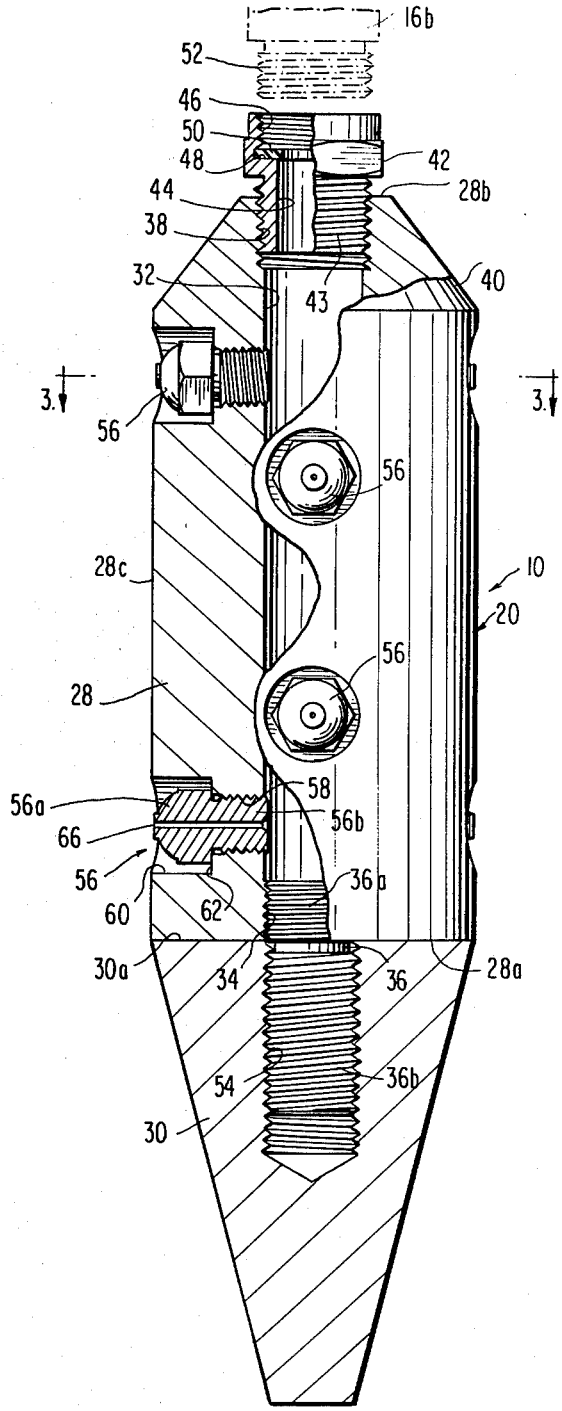
FIG. 2 is a side view, partially in section and partially broken away, of the chimney fire snuffer illustrated in FIG. 1.
Figure 3:
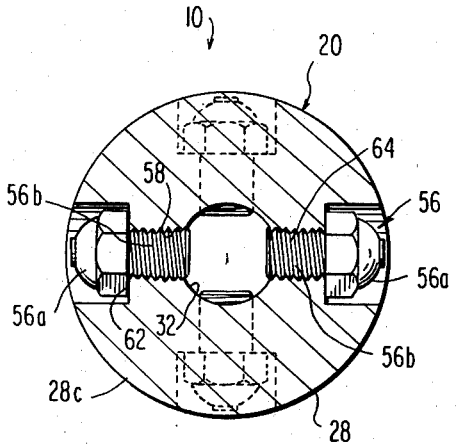
FIG. 3 is a transverse sectional view of the chimney fire snuffer of FIG. 2 taken about line 3—3.

In order to effect quick, effective extinguishing of the flame and termination of combustion of the creosote lining the interior of the chimney 12, the chimney fire snuffer of the present invention as illustrated in greater detail in FIGS. 2 and 3, is formed of heavy metal such as steel and includes either integrally or as separate part to a main cylindrical body section 28, nose cone or nose cone section 30. In the illustrated embodiment, a separate nose cone 30 is threaded to the main cylindrical body section 28 at the end 28*a*, remote from the area of attachment to the end 16*b* of the garden hose. Further, in the specific embodiment of FIGS. 1 through 3, the main cylindrical body section 28 is provided with a hollow axial bore 32, which bore 32 is tapped and threaded at end 28 as at 34 and bears a threaded plug 36 which closes off bore 32 at that end of the body section 28. The opposite end 28*b* of bore 32 is also tapped and threaded as at 38, that end of the cylindrical main body section 28 having a beveled outer periphery as at 40 leading to a radial end face. A hose coupling 42 bears threads at 43 on its exterior and is threaded to the bore interior threads 38. In turn the threaded hose coupling, which is cylindrical in form, is formed with a bore 44 and a threaded counterbore 46, defining a shoulder 48 against which a washer 50 seats to permit a sealed connection to a threaded female coupling member 52 borne by the end 16*b* of hose 16 in conventional fashion, as indicated FIG. 2, in dotted lines.

Further, in the illustrated embodiment, the nose cone 30 formed of a heavy metal (which may also be steel identical to that forming hollow cylindrical body 28), is provided with a tapped and threaded axial bore 54, from end face 30*a* inwardly, within which is positioned a threaded portion 36*b* of plug 36, the plug 36 including a further threaded portion 36*a* permitting its being threaded to the tapped and threaded bore portion 34 of the main cylindrical body 28 and functioning to close off one end of the bore 32. When the nose cone 30 is threaded to the main body, the end face 28*a* of that body abuts the end face 30*a* of the nose cone 30. The function of the nose cone 30 is to add mass to the heavy metal chimney fire snuffer at its lower end where to facilitate penetration of the accumulated creosote which must be effected to permit lowering of the snuffer within the chimney from the top 12*a* downwardly, FIG. 1, to the sites of the fire.

As stated previously, the nose cone 30 which is shown as being frustoconical may be unitary with the cylindrical body 28. Further, while it is important that it be tapered, it may have other configurations than conical or frustoconical.

In order to effect the extinguishing of the flame within the chimney in a minimum amount of time and with minimum water damage (or the elimination of water damage totally) the present invention employs a plurality of fine mist type water spray nozzles indicated generally at 56 which are borne by the main cylindrical body section 28 of the snuffer 10, preferably the nozzles form circumferential arrays at longitudinally spaced positions along body section 28 which may take the form of longitudinal rows on the periphery of the cylindrical body section 28. The nozzles 56 function to provide a fine spray of water in extremely small particle form about the full circumference of unit. In the illustrated embodiment, nozzles 56 are provided at equal circumferentially spaced positions, for example, they may be spaced from each other 90° and further, the nozzles 56 may be spaced longitudinally, although aligned in four longitudinal rows. To achieve this mounting, the cylindrical body section 28 is provided with tapped and threaded holes or bores 58 opening to counterbores 60 which penetrate some distance from the outer peripheral surface 28*c*, radially inwardly, to form shoulders 62 intermediate of bores 58 and counterbores 60. The nozzles 56 are of modified T-shape in longitudinal cross-section, FIG. 2, with an enlarged headed end 56*a* and a reduced diameter portion 56*b* which bears threads at 64 permitting the nozzles to be threaded to the bores 58 with a water tight seal. Each nozzle 56 is provided with a very small diameter axial hole 66 which extends through the length of the same through which water passes under moderate pressure and exits in the form of a fine droplets forming a water spray mist surrounding the implement 10 as it is dropped downwardly through the chimney. The headed end 56*a* of the spray nozzle 58 is provided with a characteristic hexagonal peripheral configuration to permit an appropriate tool the screw the nozzles 56 into bores 58.

While the snuffer is illustrated as having eight nozzles, the number of nozzles may vary. While preferably they are threaded at different longitudinal positions along the hollow cylindrical body 28, they may occupy positions other than those shown in the illustrated embodiment. Standard oil burner spray nozzles may be employed as long as the spray hole 66 for each nozzle 56 is appropriately sized to provide a mist type spray pattern under conventional home water pressure (or hydrant pressure) levels and to deliver water at a flow rate sufficient to produce the desired fine water mist spray throughout the periphery of the snuffer 10. Further, means may be provided for modifying the nozzle 56 to produce spray flow through the nozzle body at more than one point, for instance the single hole or bore 66 within nozzle 56 could open up at its discharge end in multiple spray orifices or in fact multiple holes may be provided within the spray nozzle 56 itself. Further, the threaded hose coupling 42 could be removed and a substitute coupling could be employed to permit connection of the snuffer 10 to the end of a larger diameter fire hose through such a reduced diameter coupling standard to the fire fighting industry.

While the invention has been particularly shown and described with reference to a preferred embodiment thereof, It will be understood by those skilled in the art that various changes in form and details may be made therein without departing from the spirit and scope of the invention.

What is claimed is:

1. A chimney fire snuffer for attachment to the end of a garden hose or the like for lowering through a chimney for extinguishing chimney fires caused by accumulated creosote on the interior surfaces of the chimney and tending to block the chimney interior, said snuffer comprising:

an elongated heavy metal cylindrical body, a bore extending axially of said body from one end thereof, a plurality of spray nozzles mounted to the periphery of said body and forming a circumferentially spaced array about said body, said spray nozzles each bearing a fine spray hole opening to the body bore, means for sealably coupling one end of said body about said bore to said hose for filling said bore with water under pressure, and wherein said heavy metal body terminates at the end remote from said hose coupling means in a solid conical end and functioning to seal off said bore at that end and to break through accumulated creosote tending to block the chimney passage when lowered at the end of the garden hose, and wherein water solely in fine water spray mist form is directed radially of said heavy metal body to quickly extinguish the flames with minimal water damage to the chimney interior and the building bearing the chimney.

2. The chimney fire snuffer as claimed in claim 1, wherein said cylindrical body comprises a hollow cylindrical body section and a separate, conical end piece threaded to the end of body bore remote from said hose coupling.

3. The chimney fire snuffer as claimed in claim 1, wherein said hollow body bears a plurality of tapped and threaded radial holes within the periphery of said body and opening up to the hollow body interior, and wherein said tapped and threaded holes are counterbored at the hollow body outer periphery, and wherein said spray nozzles are threaded at one end to said threaded hole and are of a length such that the radial outer ends of said spray nozzles are recessed within said counterbores to prevent obstruction by said spray nozzles to lowering of said snuffer within said chimney interior.

* * * * *